US010141104B2

(12) United States Patent
Habraken et al.

(10) Patent No.: US 10,141,104 B2
(45) Date of Patent: Nov. 27, 2018

(54) CONTACTLESS CONNECTOR

(71) Applicant: TE Connectivity Nederland B.V., s-Hertogenbosch (NL)

(72) Inventors: Gied Habraken, Valkenswaard (NL); Dirk-Jan Riezebos, Elst (NL); Gils Van Wijnand, Raamsdonksveer (NL); Peter Dirk Jaeger, Dussen (NL); Saoer Sinaga, Utrecht (NL)

(73) Assignee: TE Connectivity Nederland B.V., s'Hertogenbosch (NL)

( * ) Notice: Subject to any disclaimer, the term of this patent is extended or adjusted under 35 U.S.C. 154(b) by 0 days.

(21) Appl. No.: 14/739,384

(22) Filed: Jun. 15, 2015

(65) Prior Publication Data

US 2015/0310988 A1 Oct. 29, 2015

Related U.S. Application Data

(63) Continuation of application No. PCT/EP2013/076377, filed on Dec. 12, 2013.

(30) Foreign Application Priority Data

Dec. 13, 2012 (EP) ..... 12197070

(51) Int. Cl.
*H01F 17/06* (2006.01)
*H01F 27/24* (2006.01)
(Continued)

(52) U.S. Cl.
CPC ..... *H01F 38/14* (2013.01); *H01F 27/29* (2013.01); *H01F 41/10* (2013.01)

(58) Field of Classification Search
CPC ..... H01F 3/14; H01F 27/29; H01F 27/327; H01F 27/022; H01F 41/10; H01F 17/043; H01F 17/045
(Continued)

(56) References Cited

U.S. PATENT DOCUMENTS 3,195,086 A * 7/1965 Taylor ..... H01F 17/043 336/178
3,304,599 A * 2/1967 Nordin ..... H01F 3/06 174/DIG. 24
(Continued)

FOREIGN PATENT DOCUMENTS

DE 19702751 A1 7/1998
EP 1686597 A2 8/2006
(Continued)

OTHER PUBLICATIONS

The International Magnetics Association, Standard Specifications for "Ferrite Pot Style Cores", http://www.adamsmagnetic.com/pdf/Standard-Spec-for-Ferrite-Pot-Style-Cores.pdf, 12 pages, dated Mar. 2011.
(Continued)

*Primary Examiner* — Mangtin Lian
(74) *Attorney, Agent, or Firm* — Barley Snyder

(57) ABSTRACT

A contactless connector is provided and includes an inductive coupling element, a first contact lead, a second contact lead, a base plate, and an outer ferrite element. The inductive coupling element includes a plurality of windings, and the first contact lead and the second contact lead are connected to the plurality of windings and carry electric currents in opposing directions. The base plate includes a lead receiving passageway receiving both the first contact lead and the second contact lead, and the outer ferrite element is magnetically coupled to the base plate and partially surrounds the inductive coupling element.

10 Claims, 5 Drawing Sheets

(51) Int. Cl.

| | |
|---|---|
| ***H01F 27/29*** | (2006.01) |
| ***H01F 27/02*** | (2006.01) |
| ***H01F 7/06*** | (2006.01) |
| ***H01F 38/14*** | (2006.01) |
| ***H01F 41/10*** | (2006.01) |

(58) Field of Classification Search
USPC ..... 336/178, 192, 212, 83, 90; 29/602.1
See application file for complete search history.

(56) References Cited

U.S. PATENT DOCUMENTS

| | | | | |
|---|---|---|---|---|
| 4,038,625 | A * | 7/1977 | Tompkins | H01F 38/14 336/83 |
| 4,362,990 | A * | 12/1982 | Schneider | H01F 38/20 324/117 R |
| 6,847,280 | B2 * | 1/2005 | Kung | H01F 27/292 336/212 |
| 2003/0052764 | A1 | 3/2003 | Iwao et al. | |
| 2010/0156344 | A1 | 6/2010 | Inoue et al. | |
| 2010/0308950 | A1 * | 12/2010 | Hsieh | H01F 3/10 336/221 |
| 2012/0319812 | A1 * | 12/2012 | Shang | H01F 27/306 336/233 |
| 2013/0342162 | A1 | 12/2013 | Tabata et al. | |

FOREIGN PATENT DOCUMENTS

| | | | |
|---|---|---|---|
| JP | 5291732 | | 12/1975 |
| JP | 566922 | U | 9/1993 |
| JP | 2002260916 | A | 9/2002 |
| JP | 2004130846 | A | 4/2004 |
| WO | 2010124165 | A1 | 10/2010 |

OTHER PUBLICATIONS

Abstract of EP1686597, dated Aug. 2, 2006, 2 pages.
Abstract of DE19702751, dated Jul. 30, 1998, 2 pages.
Abstract of JP2002260916, dated Sep. 13, 2002, 2 pages.
PCT International Search Report, International Application No. PCT/EP2013/076377, dated Mar. 31, 2014, 4 pages.
English translation of the Chinese First Office Action, dated Jul. 5, 2016, 11 pages.
Chinese Second Office Action and English translation, dated Mar. 16, 2017, 16 pages.
English translation of Japanese Notice of Reason for Refusal, dated Oct. 14, 2017, 12 pages.
Japanese Notice of Reason for Refusal, dated Oct. 14, 2017, 11 pages.
Abstract of JP2004130864, dated Apr. 30, 2004, 1 page.

* cited by examiner

CONTACTLESS CONNECTOR

CROSS-REFERENCE TO RELATED APPLICATIONS

This application is a continuation of PCT International No. PCT/EP2013/076377 filed Dec. 12, 2013, which claims priority under 35 U.S.C. § 119 to European Patent Application No. 12197070.1 filed Dec. 13, 2012.

FIELD OF THE INVENTION

The invention relates to a connector and, more particularly, to a contactless connector for inductively connecting to a corresponding mating connector.

BACKGROUND

Generally, the invention relates to contactless connectors for inductive power transmission. Contactless power connectors are widely utilized for their various advantages over conventional power connectors, namely for: high resistance to contact failures, an unlimited number of mating cycles, a low wear and tear, prevention from electric shocks, sparks and current leaks and their operability under dirty or harsh environments.

Specifically, known contactless connectors for power transmission may be used in a variety of industrial devices such as, for instance, robotics technology, rotary applications and molding equipment. Such known contactless connectors are required to be operable under hostile environmental influences, to resist a high amount of wear and tear during the mating cycles or may be used for power transmission in humid, explosive or combustible environments.

Known configurations of contactless power connector systems allow for transmission of electrical power between a contactless connector and a mating connector.

However, in case of inductively transmitting a higher power level, a considerable amount of heat has to be taken into account that is generated from eddy currents, for instance. Heat dissipation is thus an important aspect to resolve, which however results in a need for appropriate housing materials. Therefore, the outer housing may be of metal, which results in parts of the magnetic field lines tending to flow through the metal housing. Consequently, those field lines inside the housing lead to additional losses. Overall, due to the power losses at the inductive connector, the power transmission decreases.

But even if the housing is formed in a way that eddy currents caused by the actual inductive coupling element are reduced, the magnetic field caused by the leads that feed the inductive coupling element create a significant impact on the heat development due to power losses. In particular, the outer ferrite element will include some sort of base plate where through these contact leads are fed. Any current flowing through the contact leads causes magnetic field lines around the lead wire and consequently eddy currents in this base plate. These eddy currents in turn cause a heating of the connector which is not acceptable during operation.

From the standard specifications for ferrite pot style cores of the International Magnetics Association (IMA-STD-110 2011.03, found at http://www.adamsmagnetic.com/pdf/Standard-Spec-for-Ferrite-Pot-Style-Cores.pdf) there exist various forms of so-called pot cores which take into account the difficulties connected with the B-fields around the lead receiving passageway wires. These cores with their comparatively large openings in the cylindrical side wall, however, are not efficient enough for reducing power losses caused by the power transmitting inductive coupling element itself.

FIG. 1 shows the basic parts of a known contactless connector 100 that can be inductively connected to a corresponding mating connector. The known contactless connector 100 therefore has a mating end 101 for interacting with a belonging mating connector (which, however, is not depicted in the figures), so that a contactless power transfer and optionally also a signal transmission is possible. An inductive coupling element 110, in this example a coil having a plurality of windings 115, is provided for inductively transmitting energy to the corresponding mating connector. A first and a second contact lead 103, 104 feed the current to and from the windings 115.

An outer ferrite element 107 is provided and arranged so that it at least partially surrounds the inductive coupling element. This causes an improved guidance of the B-field towards the mating connector. For further guiding the B-field, a base plate 105 which also consists of a ferritic material is provided. For feeding the first and second contact leads 103, 104 through the ferritic parts, the base plate 105 includes two lead receiving passageways 108, 109.

Additional openings 106 for other components (such as an optical fiber or an antenna) may optionally be provided in the base plate 105. Furthermore, optionally also an inner ferrite element 102 that is inserted into the inductive coupling element 110 may be provided in the contactless connector 100 according to the invention. However, such an inner ferritic element 102 is not essential for the invention.

With respect to FIG. 2, the known contactless connector 100, as already mentioned above, show a disadvantage caused by the current flowing through the first and second contact leads 103, 104, as symbolized by the arrows 111, 112. In particular, a magnetic field is induced that is guided and short-circuited by the base plate 105. This B-field might saturate the ferrite of the base plate 105 and, in case that the current is alternating, additional excessive losses will occur.

Hence, there is a need for an improved contactless connector which remedies the aforementioned disadvantages.

SUMMARY

An object underlying the invention, among others, is to provide a contactless connector which allows for reduced heat generation due to the magnetic field induced by wires feeding the inductive coupling elements, and to optimize the connector's power transfer performance.

Accordingly, a contactless connector is provided and includes an inductive coupling element, a first contact lead, a second contact lead, a base plate, and an outer ferrite element. The inductive coupling element includes a plurality of windings, and the first contact lead and the second contact lead are connected to the plurality of windings and carry electric currents in opposing directions. The base plate includes a lead receiving passageway receiving both the first contact lead and the second contact lead, and the outer ferrite element is magnetically coupled to the base plate and partially surrounds the inductive coupling element.

BRIEF DESCRIPTION OF THE DRAWINGS

The accompanying drawings are incorporated into the specification and form a part of the specification to illustrate several embodiments of the invention. These drawings, together with a description, serve to explain the principles of the invention. The drawings are merely for the purpose of illustrating the preferred and alternative examples of how the invention can be made and used, and are not to be construed as limiting the invention to only the illustrated and described embodiments. Furthermore, several aspects of the embodiments may form—individually or in different combinations—solutions according to the pre-sent invention. The following described embodiments thus can be considered either alone or in an arbitrary combination thereof. Further features and advantages will be become apparent from the following more particular description of the various embodiments of the invention as illustrated in the accompanying drawings, in which like references refer to like elements, and wherein.

DETAILED DESCRIPTION OF THE EMBODIMENT(S)

The invention will now be described in more detail with reference to the figures.

Figure 1:
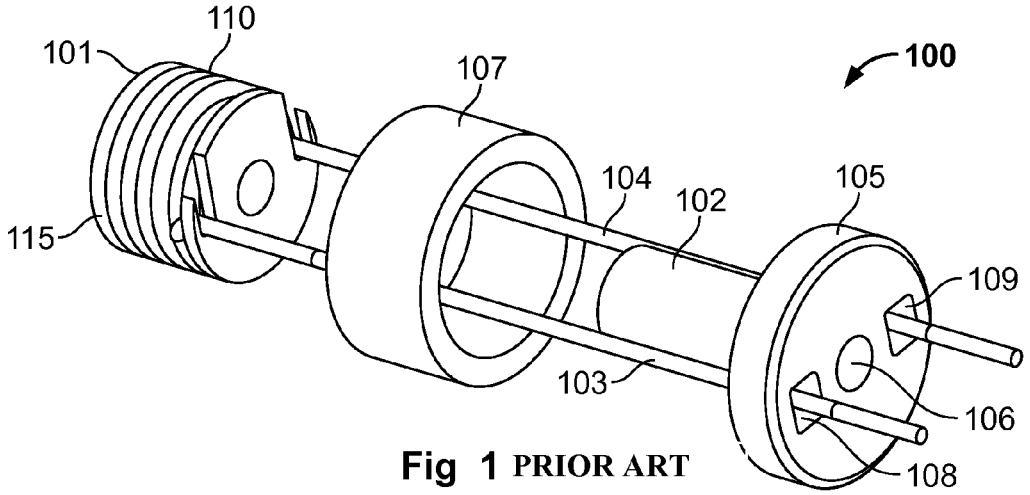
Fig 1 PRIOR ART
FIG. 1 is an exploded perspective view of a known contactless connector.
Figure 2:
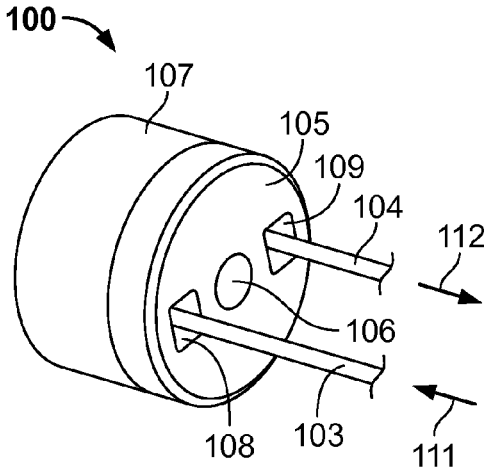
Fig 2 PRIOR ART
FIG. 2 is a perspective view of the known contactless connector of FIG. 1.
Figure 3:
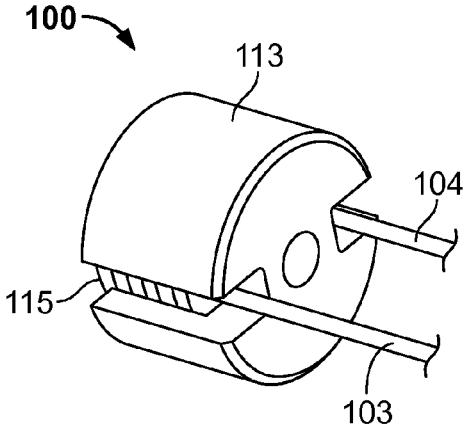
FIG. 3 is a perspective view of a contactless connector according to the invention having a pot core style ferrite element.

Now with reference 3, a contactless connector 100 according to the invention will be described. The contactless connector 100 includes like elements to the contactless connector 100 in FIGS. 1 and 2. Therefore, for the sake of brevity, only those elements that are distinguished from the contactless connector 100 of FIGS. 1 and 2 will be described. Notably, the contactless connector 100 includes a so-called pot style ferrite 113 that does not sufficiently guide the magnetic field generated by the coil windings 115 which form the inductive coupling element 110 to the mating connector.

Consequently, the idea underlying the invention is to prevent a short-circuiting of the magnetic circuit caused by the current through the contact leads 103, 104, respectively, at the same time still maintaining sufficient guidance of the magnetic field caused by the inductive coupling element located at the mating end 101 of the contactless connector.

Figure 4:
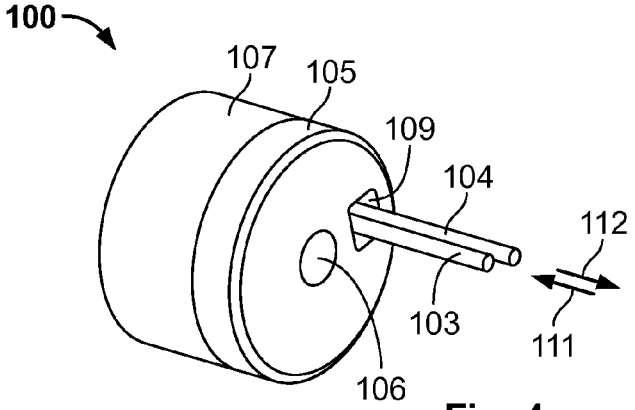
FIG. 4 is a perspective view of another contactless connector according to the invention.

This can firstly be achieved by feeding both contact leads 103, 104 through the same lead receiving passageway 109. This is schematically shown in FIG. 4. The base plate 105 may optionally include an additional component receiving passageway 106, for instance, for introducing an antenna element, an optical lead or the like.

According to the shown embodiment, the lead receiving passageway 109 is arranged at a non-centric position of the base plate 105. The first contact lead 103 and the second contact lead 104 are arranged side by side, so that the inflowing and outflowing currents cancel each other with respect to their magnetic field. Consequently, by means of the embodiment shown in FIG. 4, eddy currents and excessive heating due to the contact leads 103, 104 are prevented and on the other hand, an effective coupling to a mating connector is achieved.

A magnetic short circuit in the area of the base plate 105 caused by the current flowing through the first and second contact leads 103, 104 can also be prevented by increasing the length of the magnetic path. This concept will now be explained in various exemplary embodiments with reference to FIGS. 5 through 9.

Figure 5:
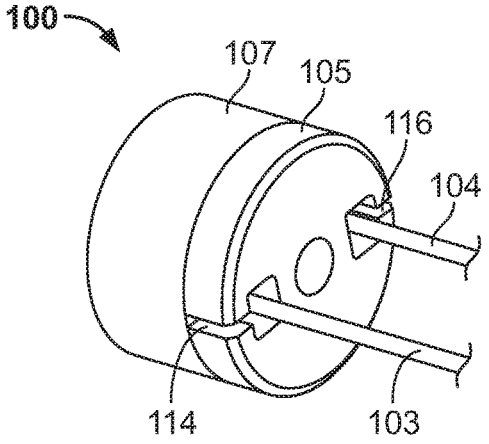
FIG. 5 is a perspective view of another contactless connector according to the invention.

As shown in FIG. 5, first and second peripheral air gaps 114, 116 are provided and extend from each of the lead receiving passageways 108, 109 to the peripheral part of the base plate 105 respectively. The first and second peripheral air gaps 114, 116 increase the magnetic path length due to the fact that the magnetic permeability of air is more than one thousand times lower than the magnetic permeability of ferrite. Of course, the first and second peripheral air gaps 114, 116 may also be filled with another non-magnetic material 121, such as a glue or resin, or the like, as shown in the embodiment of FIG. 7.

Figure 6:
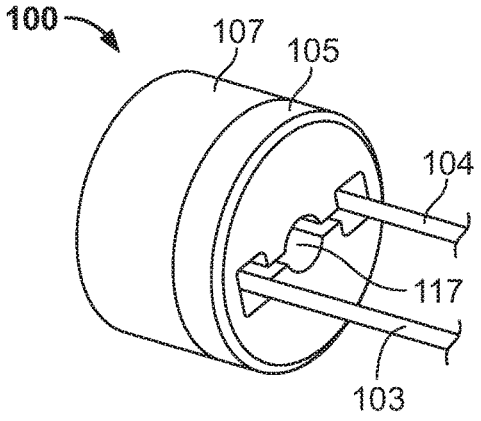
FIG. 6 is a perspective view of another contactless connector according to the invention.

Alternatively, as shown in FIG. 6, a central air gap 117 may be provided which is arranged between the lead receiving passageways 108, 109. In the shown embodiment, a component receiving passageway 106 for an optical component or an antenna is shown. However, as already mentioned, such a component receiving passageway 106 does not necessarily have to be provided.

Figure 7:
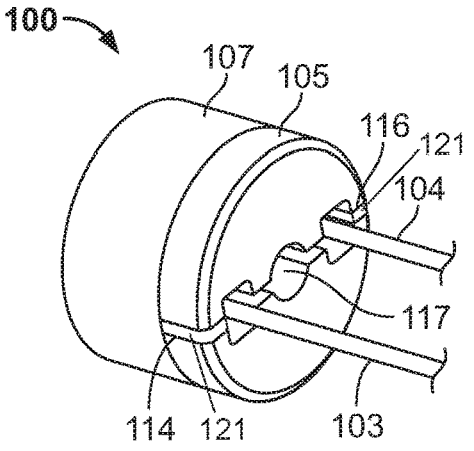
FIG. 7 is a perspective view of another contactless connector according to the invention.

FIG. 7 shows the case, where peripheral air gaps 114, 116 are combined with a central air gap 117, thus separating the base plate 105 into two halves. Advantageously, the two halves of the base plate 105 according to FIG. 7 are glued to the outer ferrite element 107 in order to keep them in place.

Figure 8:
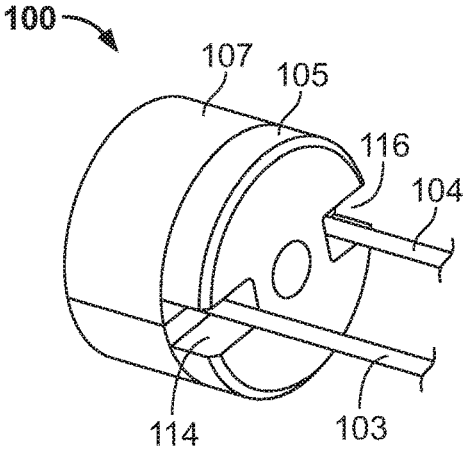
FIG. 8 is a perspective view of another contactless connector according to the invention.

The air gaps 114, 116 leading to the peripheral area of the base plate 105 may also be larger than shown in FIGS. 5 and 7. This case is shown in FIG. 8. Further, in all embodiments of the invention, the outer ferrite element 107 may also be formed by two separate parts which are formed as two half shelves, as shown in FIG. 8.

Figure 9:
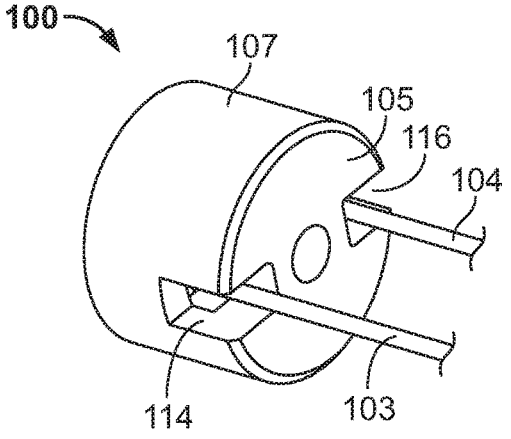
FIG. 9 is a perspective view of another contactless connector according to the invention.

On the other hand, all embodiments of the invention explained up to now may also be realized by forming the base plate 105 and the outer ferrite element 107 as one integral part. An exemplary embodiment of such a single part solution is shown in FIG. 9 for the air gap forms of FIG. 8.

All solutions according to FIGS. 4 to 9 may be combined with an inner ferrite element 102 and may be formed in various shapes which will be explained in more detail with reference to the sectional views of FIGS. 10 to 15.

It has to be noted that all the variants of cross sections shown in FIGS. 10 to 15 can be combined with air gaps or the embodiment of leading the two wires through one common lead receiving passageway which have been described before.

Figure 10:
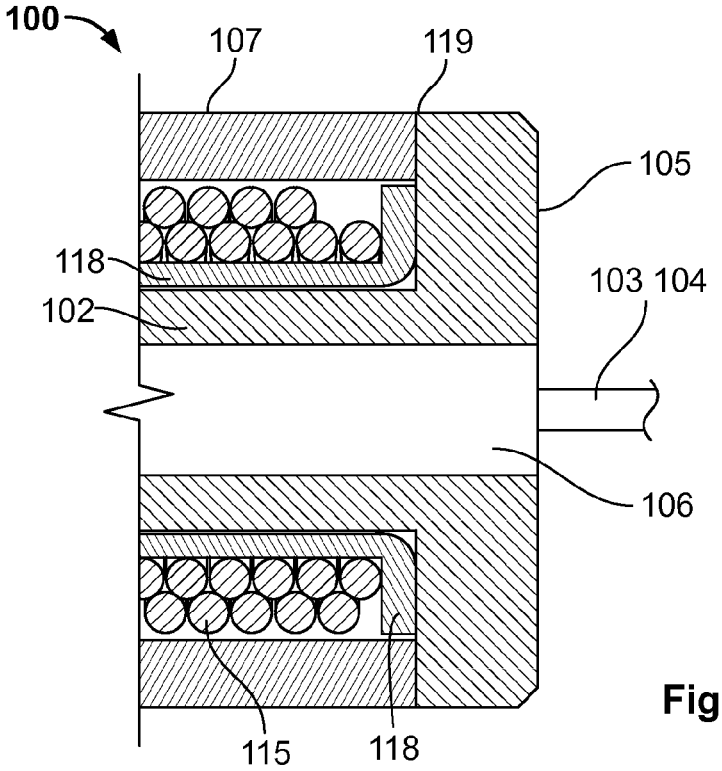
FIG. 10 is a cross sectional view of a contactless connector according to the invention.
Figure 11:
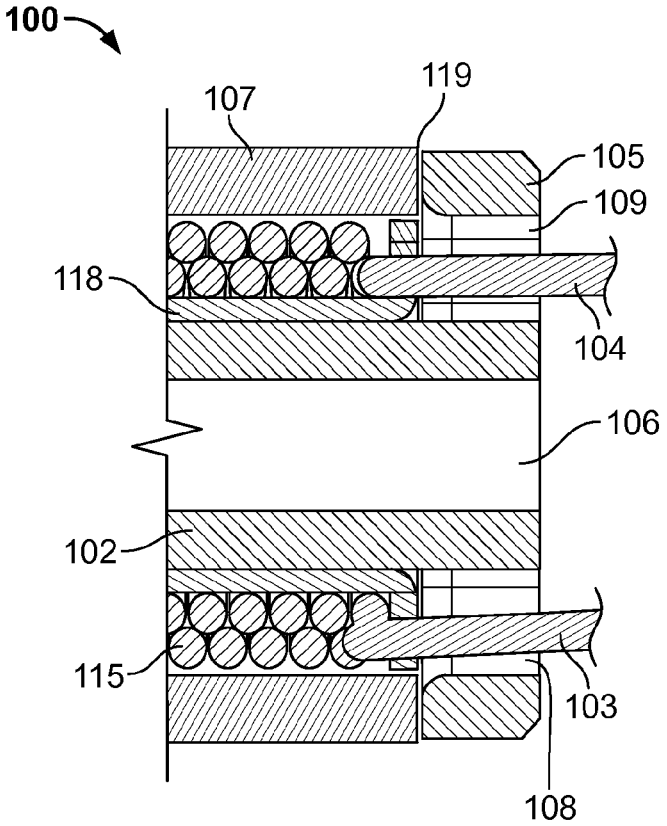
FIG. 11 is another cross sectional view of the contactless connector according to FIG. 10 that is rotated by 90°.
Figure 12:
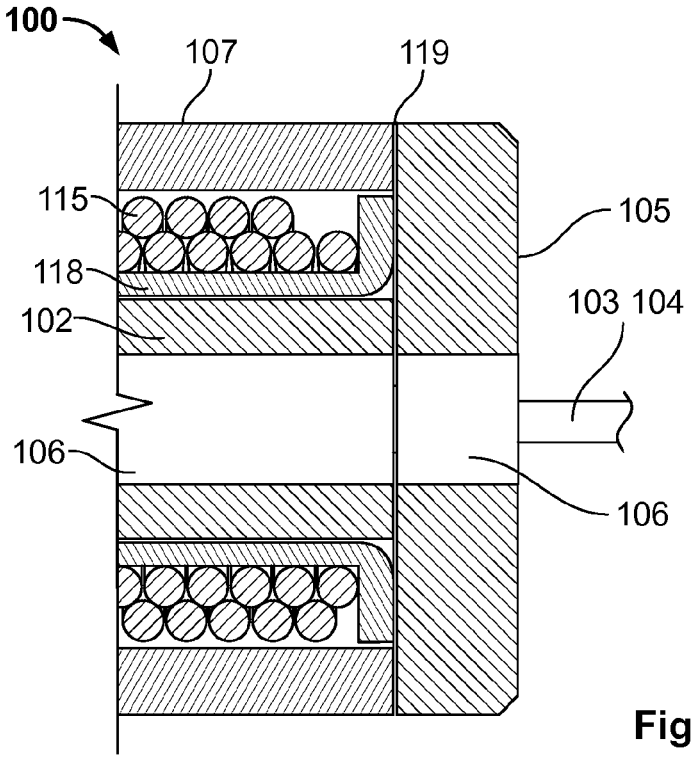
FIG. 12 is a cross sectional view of another contactless connector according to the invention.
Figure 13:
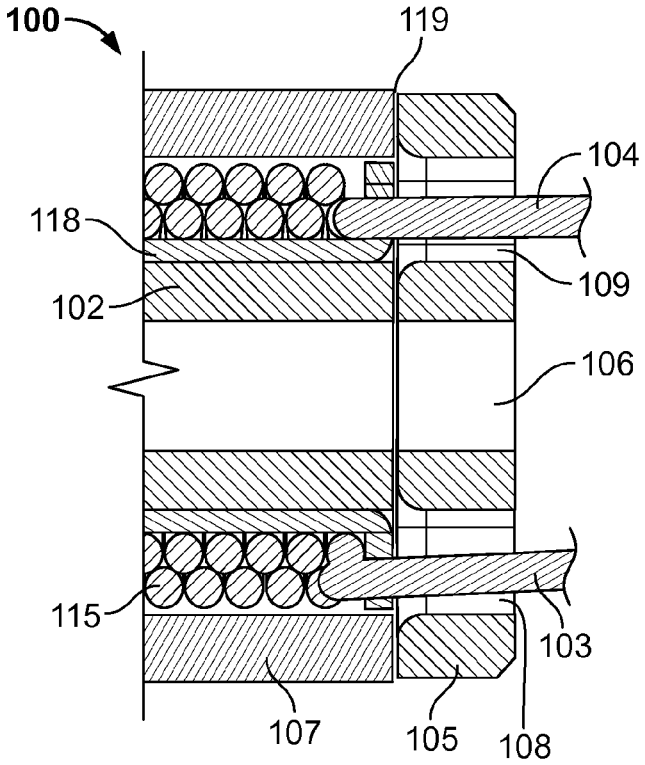
FIG. 13 is a cross sectional view of the contactless connector of FIG. 12 that is rotated by 90°.
Figure 14:
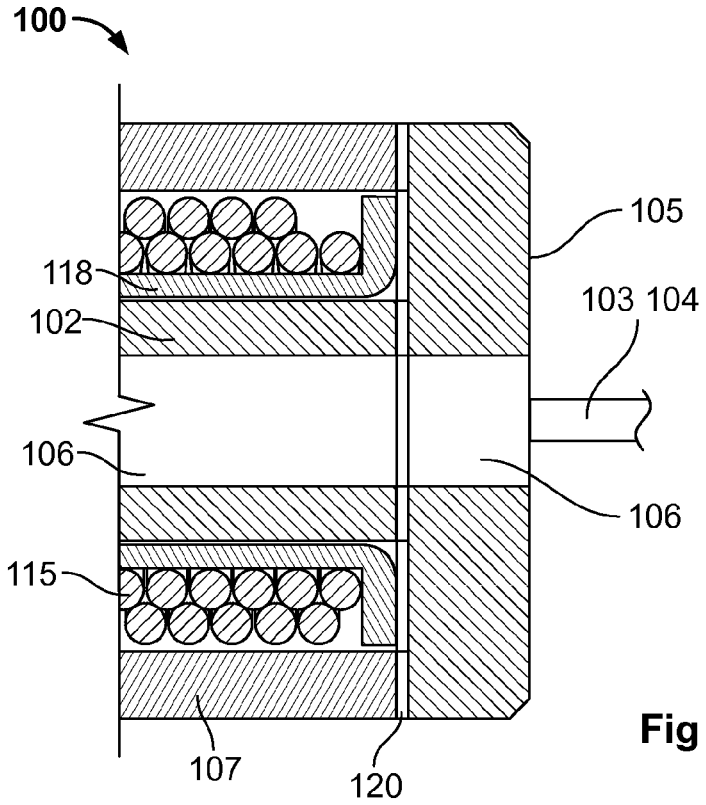
FIG. 14 is a cross sectional view of another contactless connector according to the invention.
Figure 15:
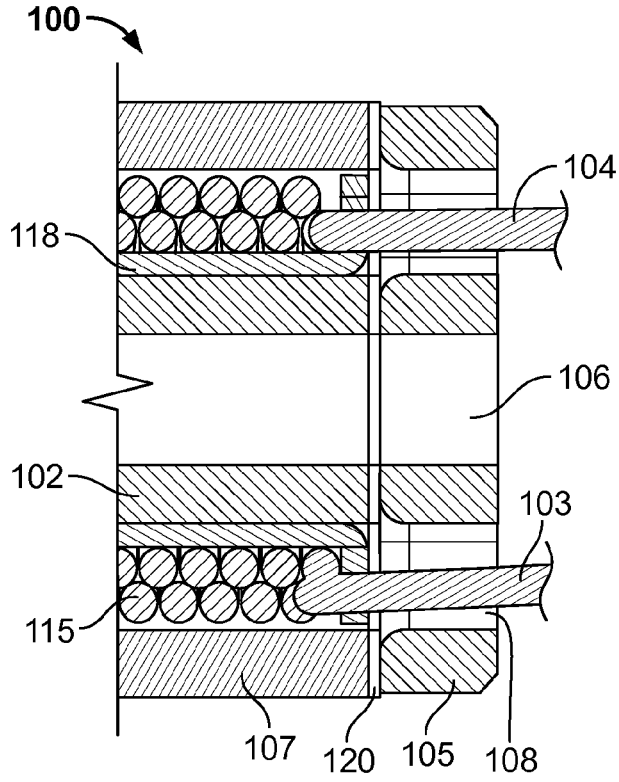
FIG. 15 is a cross sectional view of the contactless connector of FIG. 14 that is rotated by 90°.

In particular, FIGS. 10 and 11 show two orthogonal cross sections of an embodiment where the base plate 105 and an inner ferrite element 102 are formed as one single part. According to this embodiment, the base plate 105 and the outer ferrite element 107 are separated from each other by an interstice 119. The coil windings 115 that serve as the inductive coupling element 110 are wound onto an inductive coupling support element 118. The advantage of the embodiment shown in FIGS. 10 and 11 can be seen in the fact that only two separate ferrite parts are needed. A disadvantage might be seen in the fact that a single-part element consisting of the base plate 105 and the inner ferrite element 102 is more difficult to be fabricated than just simple cylinders.

However, it is clear for a person skilled in the art that also an integral fabrication of the complete ferrite part, comprising the inner ferrite element, the outer ferrite element and the base plate, can be envisaged, e. g. if the number of separate part for assembly has to be reduced.

A variant which can be fabricated more easily from a ferrite material consists of three separate parts for the base plate 105, the inner ferrite element 102 and the outer ferrite element 107. This embodiment is shown as two perpendicular cross sections in FIGS. 12 and 13. Here, the inner ferrite element 102 and the outer ferrite element 107 are each fabricated as simple cylinders and are connected to the base plate 105 via an interstice 119 which may for instance be filled with an adhesive, such as glue.

The air gaps 114, 116, 117 will have to be inserted into the base plate 105, thus significantly facilitating the fabrication of the parts.

In case that it is desired that the interstice 119 should be a non-magnetic, non-conductive gap of a well-defined dimension, one or more spacing elements 120 made from a non-magnetic, non-conductive material, such as paper or plastic foil, may be inserted into the interstice 119 during assembly of the contactless connector 100.

As already mentioned, all the variants according to FIGS. 10 to 15 may be combined arbitrarily with the embodiments shown in FIGS. 4 to 9. Furthermore, the defined spacing element 120 may also be provided for the interstice between the base plate 105 and the outer ferrite element 107 shown in FIGS. 10 and 11.

The invention is based on the finding that at the entrance of the feeding wires of the inductive coupling element, usually a coil, a magnetic short circuit will occur. Any current through the wires causes a high B-field that might saturate the ferrite where the wires are led through. If saturation occurs and the current is alternating, which is the case in all inductive coupled power transfer options, additional excessive losses will occur. By avoiding such a magnetic short circuit and therefore avoiding saturation in the ferrite material, leads to a reduction of power losses. Such a magnetic short circuit can be avoided in several ways.

Firstly, the appearance of a B-field can be avoided by preventing a net current flowing through the openings in the base plate of the contactless connector. This can be done by feeding the contact leads 103, 104 which conduct current in two opposing directions during operation through one common lead receiving passageway 109 in the ferritic base plate 105. The currents flowing in opposite directions will lead to a cancelling of the total B-field.

Alternatively, the magnetic short circuit and the heat generation associated therewith can also be avoided by increasing the magnetic path length via a particular ferrite geometry design. For instance, air gaps (114-117) of different sizes and at a variety of locations can be inserted into the magnetic path for the B-field caused by the contact leads 103, 104. The magnetic path length is increased by the fact that the magnetic permeability of air is more than one thousand times lower than the permeability of ferrite. Such an air gap can be inserted in several ways and can also be realized by using glue layers or thin non-magnetic, non-conductive foils between different ferrite parts.

The inductive coupling element may for example be formed as a coil by using wire, such as for example solid coil wire, multi-stranded coil wire or the like. The wire material can be any material suitable for the described purpose, such as for example copper.

As an example, the contactless connector according to the invention may be employed as a contactless Ethernet coupler with power transmission. In this regard, the contactless Ethernet coupler at the transmit-ting side may have an external power input, and the mating contactless Ethernet coupler at the receiving side may have an external power output. A part of the external power input may be branched off at the transmitting and receiving side, respectively, so as to supply the Ethernet circuits at the transmitting side as well as the Ethernet circuits at the receiving side. This may e.g. allow for flexible applications as well as a large range of transmittable power. As a variation, at the transmitting side, the power to be transmitted may, for instance, be inductively obtained from the data lines at the transmitting side. Optionally, external power supply may also be applied for maximum flexibility and an increased transmittable power level.

As another example, the power to be transmitted by such Ethernet coupler may inductively obtained from the data lines of the transmitting side, whereas the received power may be inductively applied to the data lines at the receiving side. Optional external power input at the transmitting side and optional external power output at the receiving side is possible. In a variation of this example, the received power at the receiving side may be used for internal power supply of the receiving side only.

The contactless connector can, for example, also be used in medical environments. In this regard, the connector may be e.g. employed in artificial joints or in human bone structures.

The contactless connector may be, for instance, be provided within a flexible cable, or in a rigid connector case, or an M12 connector case, or a case being thicker and shorter than an M12 connector case, or may e.g. be provided within a square shaped housing, or within an angled case. Also, the connector may e.g. be provided such that the electronic circuits of the connector may be provided in a separate case remote from the mechanical parts of the connector, whereas a flexible cable connects both parts.

As a further example, the contactless connector may be suited for being e.g. operated in environments containing water and/or oil. In this regard, the contactless connector is capable of providing a stable and reliable connection to a mating contactless connector, which may also be operated within watery and/or oily surroundings or be operated outside thereof. For example, the contactless connector may further be formed such that water and/or oil is/are allowed to flow through an inner part of the connector.

However, the idea according to the invention may also be advantageously employed for other sorts of inductive contactless power connectors, for instance in the field of electric vehicles.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A contactless connector, comprising:

an inductive coupling element having a coil winding;

a first contact lead and a second contact lead connected to the coil winding and carrying electric currents in opposing directions;

a base plate formed of a ferritic material and having a first lead receiving passageway receiving a contact lead of the first contact lead or the second contact lead, a second lead receiving passageway provided opposite the first lead receiving passageway receiving a contact lead of the other of the first contact lead or the second contact lead, an air gap extending continuously between the first and second lead receiving passageways and along a peripheral surface of the base plate and arranged in a magnetic path of a magnetic field induced by electric current flowing through the contact lead of the first contact lead or the second contact lead, and a component receiving passageway, a portion of the air gap along the peripheral surface of the base plate is filled with a non-magnetic material;

an inner ferrite element formed as a single part with the base plate, the component receiving passageway extending through the base plate and the inner ferrite element; and an outer ferrite element partially surrounding the inductive coupling element, magnetically coupled to the base plate, and open to the inductive coupling element at a mating end of the outer ferrite element opposite the base plate.

2. The contactless connector according to claim 1, wherein the inner ferrite element is magnetically coupled to the outer ferrite element via the base plate.

3. The contactless connector according to claim 2, wherein the inductive coupling element is positioned to partially surround the inner ferrite element.

4. The contactless connector according to claim 3, wherein the outer ferrite element and the base plate are separate pieces.

5. The contactless connector according to claim 1, wherein the base plate is distanced from the outer ferrite element by a non-magnetic spacing element.

6. The contactless connector according to claim 1, wherein the outer ferrite element includes another air gap extending a length thereof.

7. The contactless connector according to claim 1, wherein the air gap is a smaller opening in the base plate than the first lead receiving passageway and the second lead receiving passageway.

8. The contactless connector according to claim 1, further comprising an inductive coupling support element disposed around the inner ferrite element.

9. The contactless connector according to claim 8, wherein the inductive coupling element is wound onto the inductive coupling support element.

10. A method for manufacturing a contactless connector, the method comprising the steps of:

providing an inductive coupling support element disposed around an inner ferrite element;

arranging an inductive coupling element around the inductive coupling support element;

enclosing a part of the inductive coupling element with an outer ferrite element that is magnetically coupled to a base plate formed of a ferritic material, the base plate separate from the inductive coupling element and covering an end of the inductive coupling element, the outer ferrite element open to the inductive coupling element at a mating end of the outer ferrite element opposite the base plate, the base plate formed as a single part with the inner ferrite element and having a first lead receiving passageway, a second lead receiving passageway, an air gap extending continuously between the first and second lead receiving passageways and along a peripheral surface of the base plate, and a component receiving passageway, the component receiving passageway extending through the base plate and the inner ferrite element;

filling a portion of the air gap along the peripheral surface of the base plate with a non-magnetic material;

connecting a pair of contact leads to the inductive coupling element that carry electric currents in opposing directions; and positioning each of the pair of contact leads through one of the first and the second lead receiving passageways, the air gap is arranged in a magnetic path of a magnetic field induced by the electric current flowing through at least one of the pair of contact leads.

* * * * *